US005413173A

United States Patent [19]

Mills et al.

[11] Patent Number: 5,413,173

[45] Date of Patent: May 9, 1995

[54] WELL APPARATUS INCLUDING A TOOL FOR USE IN SHIFTING A SLEEVE WITHIN A WELL CONDUIT

[75] Inventors: Aubrey C. Mills; Billy R. Newman, both of Houston; John A. Barton, Arlington; Neil H. Akkerman, Houston, all of Tex.

[73] Assignee: AVA International Corporation, Houston, Tex.

[21] Appl. No.: 163,824

[22] Filed: Dec. 8, 1993

[51] Int. Cl.[6] ..... E21B 23/04

[52] U.S. Cl. ..... 166/212; 166/237

[58] Field of Search ..... 166/237, 321, 373, 374, 166/386, 212

[56] References Cited

U.S. PATENT DOCUMENTS

| | | | |
|---|---|---|---|
| 4,243,099 | 1/1981 | Rodgers, Jr. | 166/237 X |
| 4,396,061 | 8/1983 | Tamplen et al. | 166/237 X |
| 4,817,723 | 4/1989 | Ringgenberg | 166/323 X |
| 4,862,957 | 9/1989 | Scranton | 166/237 X |
| 4,928,772 | 5/1990 | Hopmann | 166/386 |
| 4,944,351 | 7/1990 | Eriksen et al. | 166/386 X |
| 5,082,062 | 1/1992 | Wood et al. | 166/237 X |

*Primary Examiner*—Ramon S. Britts
*Assistant Examiner*—Frank S. Tsay
*Attorney, Agent, or Firm*—Vaden, Eickenroht, Thompson & Feather

[57] ABSTRACT

Well apparatus is disclosed in which a tool is lowered on a pipe string into a well conduit for shifting a sleeve slidably mounted within a tubular housing connected as part of the well conduit. The sleeve has vertically spaced grooves about its inner diameter, and the tool has latches which are selectively moved into and out of engagement with a selected groove in the sleeve in response to the control of the pressure of fluid within the tool. When engaged in a groove, the tool may be raised or lowered with the pipe string to raise or lower the sleeve.

15 Claims, 8 Drawing Sheets

70
40
51
52
4
4

71
53
50
5
5
54
47
72

43A
45
48
43
42
63

62
61
6
6
76
75
61A
42

62
61
76
75
61A
42

62
61
76
75
61A
42

FIG. 4
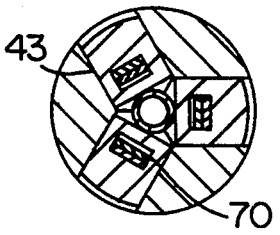
FIG. 5
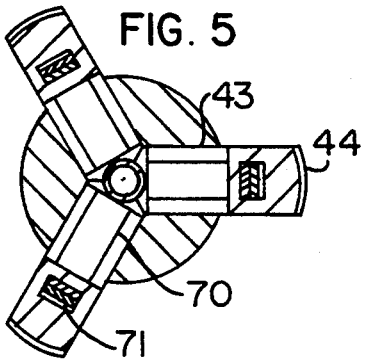
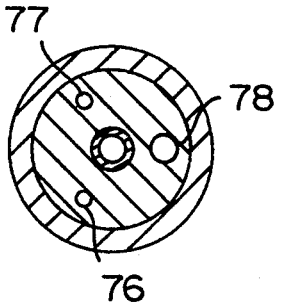
FIG. 6
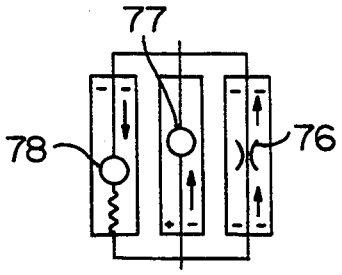
FIG. 7

20B
45
70
71
53
51
29A
52
50
29
54
29B
24
47
46
21
25
72
20A
43A
22
20
40
42

20B
45
70
71
53
51
29A
50
52
29
54
29B
24
47
46
21
25
72
43A
20A
22
20
40
42

25
22
27
20
23
28
20C 43A
45
30B
30
70
26
71
53
51
50
52
30A
54
47
46

WELL APPARATUS INCLUDING A TOOL FOR USE IN SHIFTING A SLEEVE WITHIN A WELL CONDUIT

BACKGROUND OF THE INVENTION

This invention relates to well apparatus of the type in which one or more sleeves are adapted to be selectively shifted between alternate positions within a well conduit by means of a well tool lowered into the well conduit on a pipe string. More particularly, it relates to improvements in well apparatus of this type which is particularly useful in shifting one or more of such sleeves within a horizontal portion of the well, in that the tool may be manipulated in order to shift each sleeve without the need for applying torque to the pipe string, which may be coil tubing capable of transmitting only axial loads at the substantial depths at which such sleeves are located.

DESCRIPTION OF PRIOR ART

As shown, for example, in U.S. Pat. No. 4,928,772, the sleeve may be mounted for shifting within the bore of a housing connected as part of the well conduit and having one or more ports adapted to be closed in one alternate position of the sleeve or opened in the other alternate position thereof. As shown, the sleeve has vertically spaced grooves about its inner diameter each for receiving a key carried by a tool suspended from coil tubing and having a profile matching that of each groove. More particularly, each groove has a "square" or abrupt shoulder one of which faces up and the other down, and adapted, depending on the orientation of the key, to be engaged by a similarly shaped shoulder on the key as the key is spring-pressed into the groove when opposite thereto. Thus, with the key arranged with its shoulder up to engage the down shoulder on one of the grooves, the sleeve may be shifted to its upper position upon raising of the tool with the pipe string, and, with it arranged with its shoulder down to engage the up shoulder on the other of the grooves, the sleeve may be shifted to its lower portion upon lowering of the tool.

As will be appreciated, however, the key must be oriented in the desired vertical direction to shift the sleeve to in a desired direction, and, in order to shift the sleeve in the opposite direction, or, alternatively to shift a plurality of vertically spaced sleeves in the well conduit to opposite positions—i.e., one up and one down—it is necessary to either pull the pipe string in order to reverse the position of the key or to install a pair of vertically spaced oppositely oriented keys in the pipe string.

As also shown in such patent, the keys are of such construction as to cooperate only with a groove of matching profile, hence limiting its use to shifting only certain sleeves. Furthermore, the keys must be "selective" in the sense that they match only one sleeve in the conduit, and hence will not become unintentionally engaged in another sleeve at another vertical level.

SUMMARY OF THE INVENTION

The object of this invention is to provide apparatus of this type in which the shifting tool is capable of shifting a sleeve in either or both directions, shifting any of a series of vertically spaced sleeves in the well conduit and shifting sleeves having grooves of various configurations.

This and other objects are accomplished in accordance with the illustrated embodiment of the invention, by a well apparatus of the general type above described in that it includes a housing connectible in a well conduit and having a bore therethrough, a sleeve vertically shiftable in the bore between upper and lower positions and having a groove about its inner diameter, and a tool for shifting the sleeve between its upper and lower positions which comprises a tubular body connectible to a pipe string for lowering into the well conduit, and latches carried by the body for radial movement between a retracted position in which the tool moves freely through the sleeve and an expanded position in which the latches will engage in the groove when opposite thereto, the groove and each of the latches having shoulders which, when the latches are engaged in the groove, will engage with one another to permit the sleeve to be shifted from a first to a second position upon vertical movement of the tool with the pipe string.

In accordance with the novel aspects of this invention, the tool also includes means for moving the latches to their outer positions in response to a predetermined increase in the pressure of fluid within the tool body, as well as means yieldably urging the latches to their inner positions so that, upon a predetermined reduction in such pressure, the latches may be retracted from the groove to permit the tool to move with the pipe string vertically out of the sleeve. The sleeve is received in a recess in the bore of the housing which has a shoulder at one end, and the latches have shoulders in position to engage with the shoulder at one end of the recess, as the sleeve is shifted to its second position, so as to force the latches out of the groove and thus free the tool to move vertically with the pipe string. Also, the dog and shoulder of each latch are of such size as to prevent the entry of the dog between the end of the sleeve and recess if the sleeve is already shifted to such second position.

As illustrated, the sleeve has vertically spaced grooves about its inner diameter, with each groove having a shoulder at one end opposite a shoulder at the end of the other groove, and each of the latches has opposed shoulders one of which will, when the latches are expanded, engage with a shoulder of the selected sleeve to permit the sleeve to be shifted from first to second position upon movement of the tool with the pipe string in one vertical direction. In accordance with the present invention, however, the sleeve is received in a recess in the bore of the housing which has a shoulder at each end, and the latches have raised shoulders thereon in position to engage with a shoulder at one end of the recess, as the sleeve is shifted to one of its positions, so as to force the latches out of the groove and thus free the tool to move vertically with the pipe string.

More particularly, there are a plurality of housings connectible in vertically spaced-apart relation within a well conduit and each having a bore therethrough, a sleeve is vertically shiftable in the bore of each housing between upper and lower positions and having a groove about its inner diameter, and the tool enables each sleeve to be selectively shifted between its upper and lower positions, since its latches are carried by the body for radial movement between a retracted position in which the tool moves freely through each sleeve and an expanded position in which the latches will engage in the groove of a selected sleeve when opposite thereto, and when retracted from the groove, to be moved with the pipe string vertically out of the sleeve and into a position for shifting another sleeve.

BRIEF DESCRIPTION OF THE DRAWINGS

In the drawings wherein reference characters are used throughout to designate like parts:

FIG. 4 is a cross-sectional view of the tool, as seen along broken lines 4—4 of FIG. 1B;

FIG. 5 is a cross-sectional view of the tool, as seen along broken lines 5—5 of FIG. 2B;

FIG. 6 is a cross-sectional view of the tool, as seen along broken lines 6—6 of FIG. 1C;

FIG. 7 is a diagrammatic illustration of passageways formed in the body of the tool, as seen in FIG. 6;

DETAILED DESCRIPTION OF THE DRAWINGS

With reference now to the details of the drawings, the housing 20 shown in FIGS. 8A and 8B, 9A and 90B, 10A and 10B, and 11A and 11B is adapted to be connected in a well conduit which may be a well casing or a well tubing installed in a well. As shown, the housing is installed in a horizontal section of the well which, of course, may be a substantial distance from the vertical portion of the well leading to the wellhead, and is made up of intermediate section 20A as well as end sections 20B and 20C threadedly connected in end-to-end relation.

One or more ports 21 are formed in the housing to connect a recess 23 in the bore of the housing intermediate the inner ends of the housing sections 20B and 20C with the outside of the housing. A sleeve 22 is slidable in the recess between positions opening and closing the ports. Thus, as previously mentioned, it may be desirable to selectively open and close the ports for any number of reasons, either to communicate the inside of the well conduit with the outside thereof or vice versa.

Figure 9A:
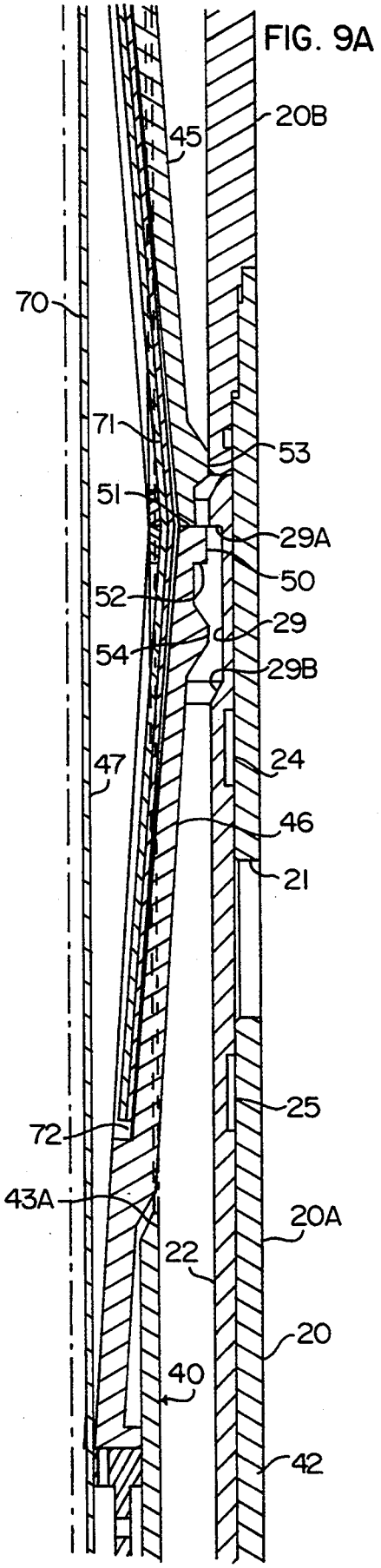
FIGS. 9A and 9B are views similar to FIGS. 8A and 8B, but upon further movement of the shifting tool to the left to cause the raised shoulders on the latches to be forced inwardly by a shoulder at the end of the recess in order to withdraw the latches out of the groove in the sleeve as the sleeve is moved to its left-hand position.
Figure 11A:
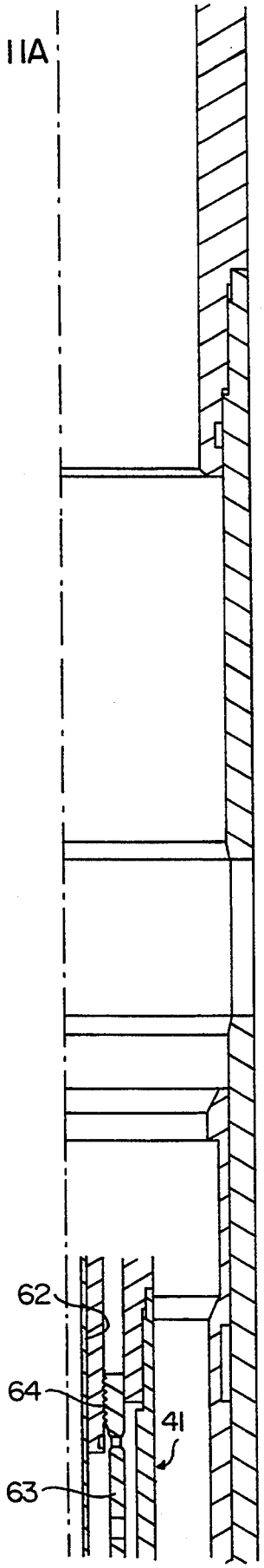
FIGS. 11A and 11B are views similar to FIGS. 10A and 10B, but upon further movement of the shifting tool to the right to cause the shoulders on the latches to force the latches out of engagement with the groove as the sleeve is moved into its right-hand position.
Figure 10B:
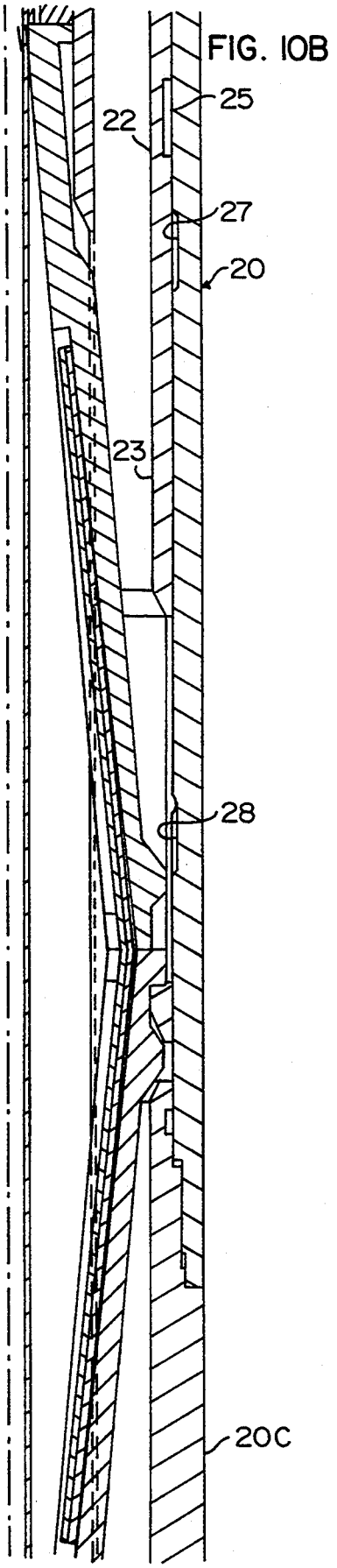
Figure 11B:
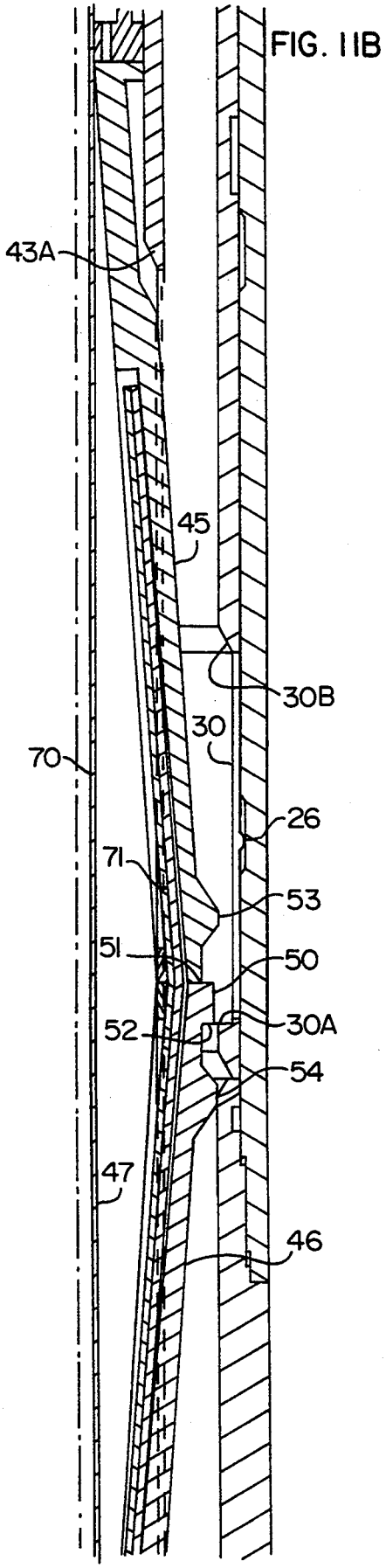

Packing 24 and 25 are carried about the outer diameter of the sleeve for disposal on opposite sides of the port 21, as the sleeve is moved to the left to close the ports, as shown in FIG. 9A, and to one side of the ports when the sleeve is moved to the right to open the ports, as shown in FIGS. 11A and 11B. The sleeve is retained in each of the positions by means of a flexible detent 26 about its outer side disposable in a groove 27 in the housing when the sleeve is moved to its left position, and in a groove 28 about the recess when the sleeve is moved to its right position. These detents merely serve to releasably hold the sleeve in its respective positions until an axial longitudinal force of predetermined value is applied thereto.

The sleeve has a left-hand groove 29 formed thereabout adjacent its left end and a groove 30 thereabout adjacent its right end. The groove 29 has an abrupt shoulder 29A on its left end and a tapered surface 29B at its right-hand end. The groove 30 has an abrupt shoulder 30A on its right-hand end and a tapered surface 30B on its left-hand end. Thus, the abrupt shoulders 29A and 30A are opposed to one another.

The shifting tool, which is indicated in its entirety by reference character 40, comprises a tubular body 41 connectible at its left end to the lower end of a pipe string so as to permit it to be raised and lowered within the well conduit into and out of each of the housings and shiftable sleeves. As previously described, this pipe string may be coil tubing or in any case a thin string incapable of transmitting torque at great depths in the well. The body is closed at its right-hand end but has one or more orifices 42A formed therein to permit the build-up of pressure within the tubular body upon circulation of the fluids downwardly therethrough. Alternatively, the lower end of the tool body may be connected to a lower portion of the pipe string in which an orifice may be formed.

Figure 1A:
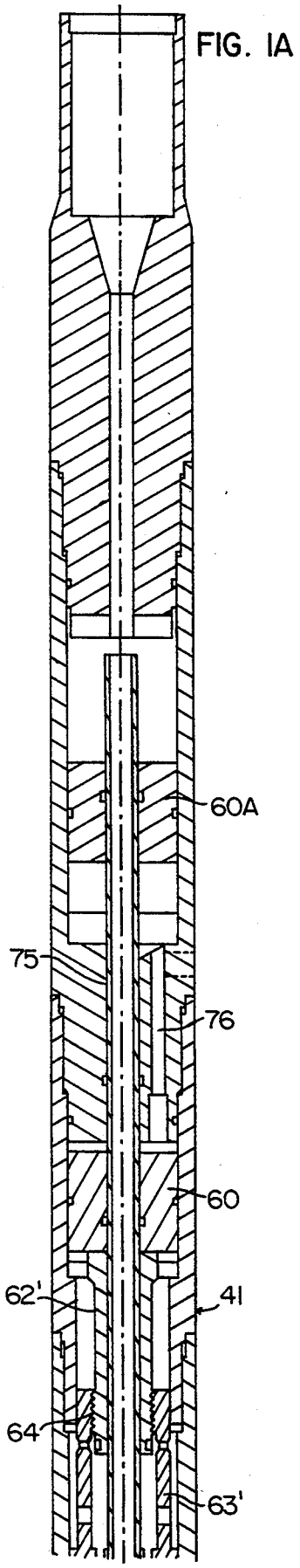
FIGS. 1A, 1B, and 1C are vertical sectional views of the upper, intermediate and lower portions of the shifting tool with the latches thereof in retracted positions they would occupy as the tool was lowered into the well conduit.
Figure 2A:
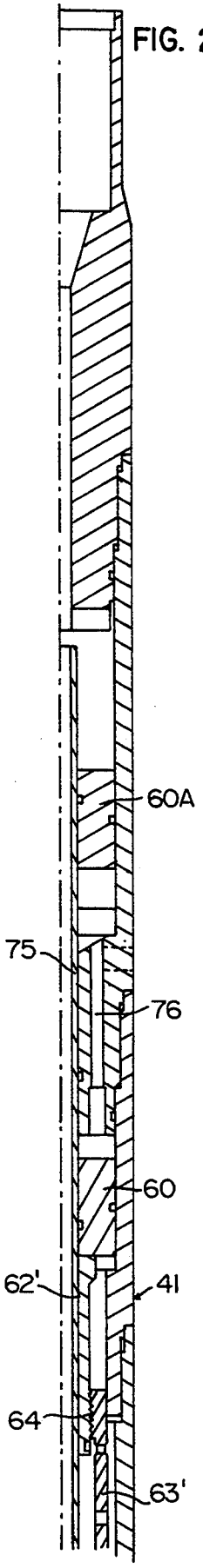
FIGS. 2A, 2B, and 2C are partial vertical sectional views of the upper, intermediate and lower portions of the shifting tool, similar to FIGS. 1A, 1B, and 1C, but upon expansion of the latches in response to an increase in fluid pressure within the tool.
Figure 3A:
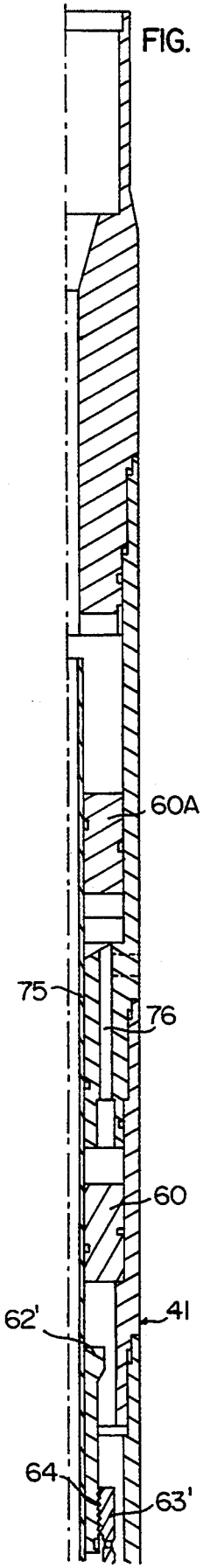
FIGS. 3A, 3B, and 3C are further partial vertical sectional views of the upper, intermediate and lower portions of the tool, similar to FIGS. 1A, 2B, and 2C, but upon the application of vertical force to the tool through the pipe string in order to release the latches for inward movement out of the groove in the sleeve.
Figure 1B:
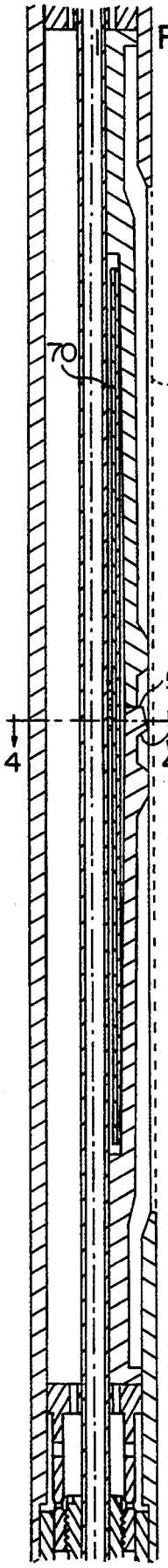

The tubular body is made up of a series of tubular sections connected to one another in end-to-end relation, including an intermediate section 42 having windows formed therein to connect the inner and outer diameters of the tubular body at circumferentially spaced apart relation, as best shown in FIGS. 4 and 5. A series of latches are mounted on the body each within a window 43 for guided movement radially between retracted and expanded positions. Thus, as shown in FIGS. 1B and 4, in their retracted positions, the latches form continuations of the outer diameter of the tubular body, while in their outer positions, they extend outwardly from the body for engaging in a groove in the sleeve, as will be described to follow.

More particularly, each latch comprises a beam made up of a pair of beam sections 45 and 46 having their inner ends engaged and their outer ends restrained against outward movement, as will be described. More particularly, each of the latch beams are disposed on the outer side of a sleeve or liner 47 which forms a continuation of the inner diameters of the end sections of the tubular body. As will be understood from a comparison of FIGS. 1B and 2B, the ends of the beam sections are so formed that oppositely disposed inward forces at their outer ends will cause them to bend outwardly between their retracted and expanded positions of FIGS. 1B and 2B.

The right-hand beam section 46 has a dog 50 formed about its inner end and having abrupt shoulders 51 and 52 on its left- and right-hand sides. A raised shoulder 53 is formed on the left beam section 45, near its inner end, but spaced from the shoulder 51, and the right beam section 46 has a similar shoulder 54 formed thereon near its inner end, but spaced from the abrupt shoulder 52. When the beams are expanded, the outer diameters of the dog and shoulders 53 and 54 are essentially aligned.

As previously described, the beams are adapted to be moved from their retracted to their expanded positions in response to a predetermined increase in the pressure of the fluid within the body of the tool. For this purpose, a piston 60 is sealably slidable in the annular space between the sleeve 47 and enlarged diameter portion of the tubular body on the left end of the left beam section 45, and a piston 61 is sealably slidable within the annular space to the right of the right beam section 46. The increased fluid pressure is admitted to the annular space on the outer ends of each of the pistons through gaps at each end of the sleeve so as to cause the pistons to move inwardly toward one another and thus to exert inward forces on the ends of the beams.

Thus, inward force is transmitted to the opposite ends of the beams by threadedly connected tubular members 62 and 63 disposed within the annular space between the inner ends of the pistons and outer ends of the beam sections. As will be described, and in an emergency, when the beams cannot otherwise be disengaged from a groove, the connection of these members to one another is shearable in response to a predetermined axial force.

Figure 2B:
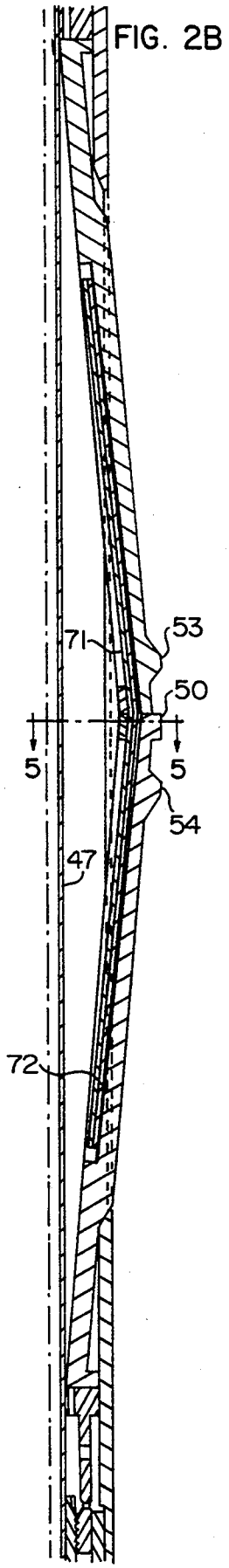
Figure 3B:
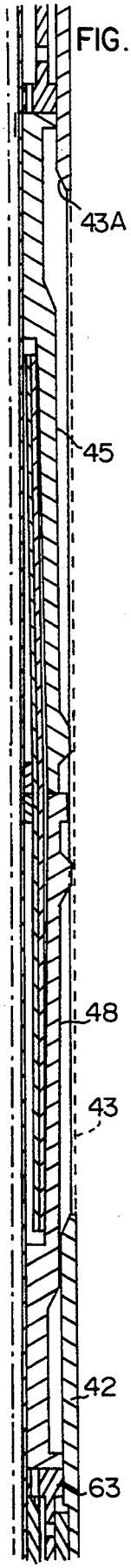
Figures 1C, 2C, 3C:
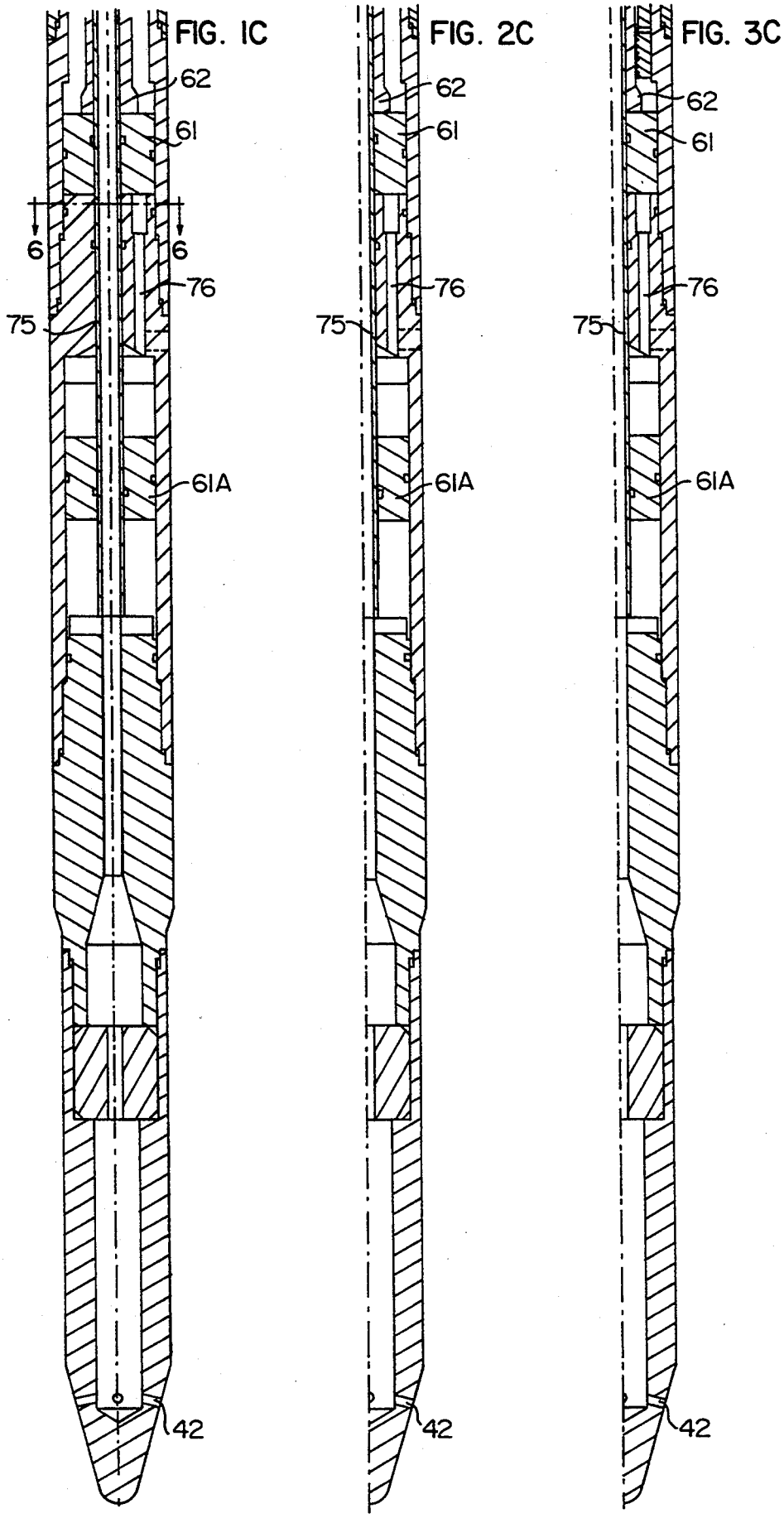

Thus, as will be understood from the drawings, inward movement of the pistons in response to increased pressure will cause the outer ends of the beam sections to be moved toward one another to in turn cause the beam to bend outwardly, as shown in FIG. 2B. As this occurs, the outer portions of the beams will slide over tapered surfaces 43A on the ends of the windows, which also facilitate return of the beam sections to their inner positions.

Bow springs 70 extend through slots formed in the inner ends of the beam sections, so as to retain them in positions close to the inner sides of the beam sections. More particularly, the bow springs extend for a substantial longitudinal extent of an enlarged diameter portion 72 on the inner sides of the beam sections, and are so constructed as to normally assume flat positions. Thus, the springs provide relatively long moment arms about which a force is exerted to yieldably urge the beam sections inwardly, and thus return them to their retracted positions in response to a predetermined decrease in the fluid pressure within the body, when, for example, the sleeve has been shifted, and it is desired to move the tool to another position in the well conduit.

As previously mentioned, it is often the practice in operating downhole tools of this general type which are activated or deactivated in response to increases and decreases of fluid pressure in the tool itself, to install in the pipe string above the tool to be operated, a so-called bidirectional impact tool. These supplemental tools are especially useful when the tool to be operated is run on coil tubing which makes it difficult to transmit large vertical load to the tool. Thus, these impact tools operate in response to the control of fluid pressure in the string above them to transmit pulsations to the tool to be operated. As previously described, however, although useful in transmitting the necessary force to the tool through the pipe string, the pulsations could present a problem in that they might permit the dogs of the latches to move out of a groove in the shiftable sleeves.

Hence, according to the present invention, a means is provided for dampening these pulsations, and, for this purpose, the tool body has a reduced diameter portion 75 outwardly of the pistons 60 and 61 and sealably engaged with the sleeve 47, and an orifice 76 is formed therein of a size to provide the desired dampening effect of the fluid acting on the outer ends of the piston. More particularly, additional pistons 60A and 61A are sealably slidable within the annular space outwardly of the orifices therefor thereby forming pressure chambers between the pistons 60 and 60A and 61 and 61A for fluid which must circulate through the orifices.

A one-way check valve 77 is disposed in another passageway through each outer piston and arranged to allow relatively rapid flow into the chamber, but to prevent flow out of the chamber except through the orifices. Hence, although the latches may be expanded outwardly into a groove relatively rapidly, any tendency for them to move out of the groove despite pulsations from the impact tool is minimized due to the orifices. A pressure relief valve 78 is also disposed within still another passageway through each outer piston to relieve pressure in the chamber in the event it became excessive. In addition to serving these functions, the outer pistons also serve as a barrier to debris in the body of the tool which might otherwise clog the passageways.

As previously described, in use, the shifting tool is normally lowered with the pipe string to a position within the well conduit just above or just below the sleeve to be shifted. More particularly, it is initially so located with the latches retracted, thus permitting the operator to select the sleeve to be shifted, it being understood that normally there would be a series of tubular housings in vertically spaced relation within the well conduit with sleeves installed in each. Thus, at this stage, latches would move freely through the well conduit to the desired position either just above or just below the sleeve to be shifted.

When the operator is prepared to shift the selected sleeve, he will increase circulation within the tool, and thus increase the pressure of fluid in the tool to cause the latches to move to their outer positions. This, of course, will urge them against the inner diameter of the conduit so that, as the tool is moved vertically to a position opposite the groove of the sleeve, the dog and shoulders of the latches will be urged outwardly into the groove. Thus, assuming that the sleeve occupied its right-hand position, as shown in FIGS. 8A and 8B, and was to be shifted to its left-hand position, the tool would be raised or lowered to a position in which the dogs were disposed opposite thereto so that the fluid pressure would urge them outwardly into the groove.

Figure 8A:
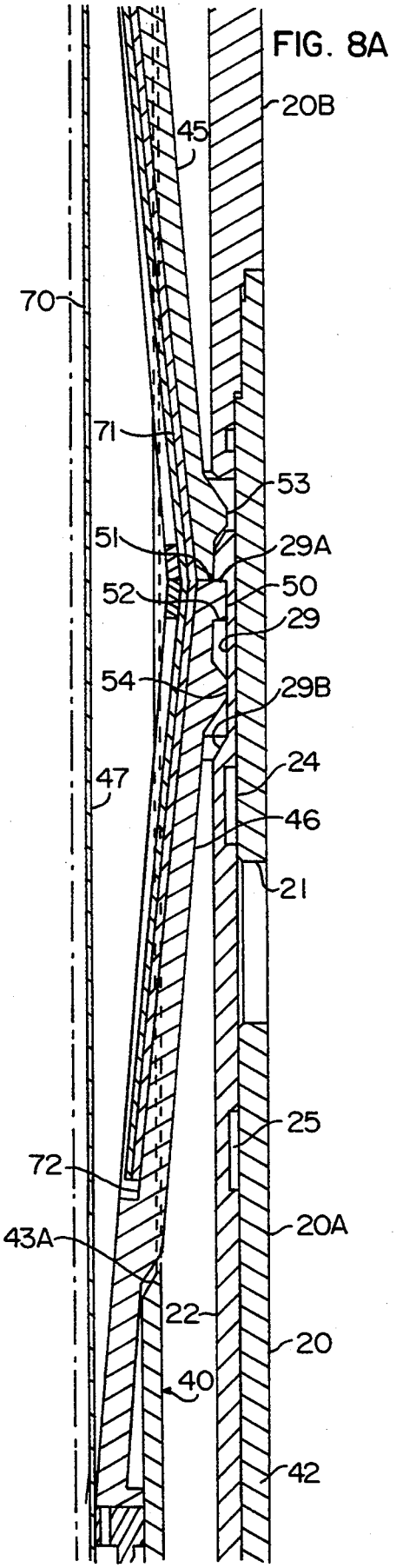
FIGS. 8A and 8B are partial sectional views of the intermediate and lower portions of the shifting tool with its latches engaged in the left groove of the sleeve in the recess of the housing of the well conduit and upon movement of the shifting tool to the left to shift the sleeve toward its left-hand position in the recess.
Figure 8B:
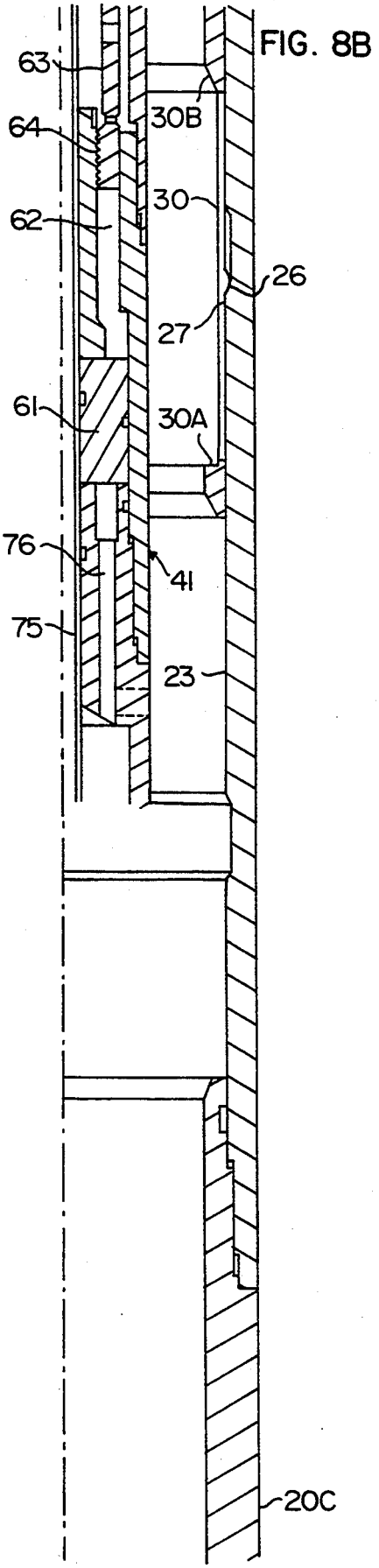
Figure 9B:
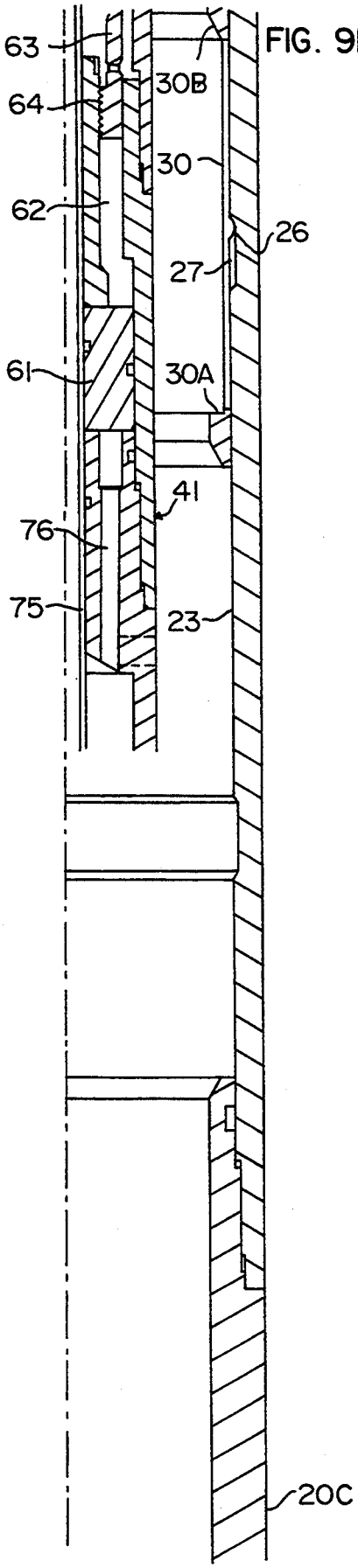
Figure 10A:
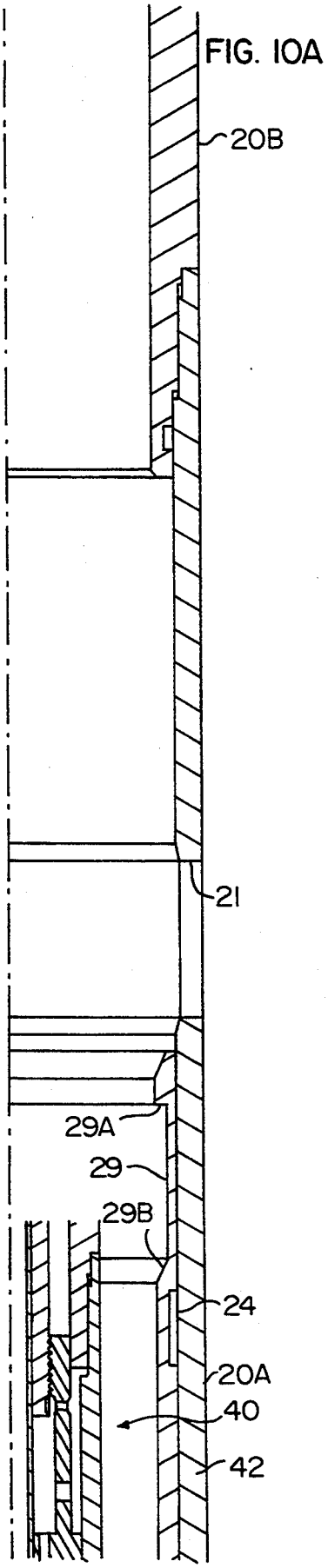
FIGS. 10A and 10B are partial sectional views of the upper and intermediate portions of the shifting tool with the latches thereof moved outwardly to engage the right-hand groove of the sleeve received in the recess of the housing and upon movement of the sleeve with the tool to the right toward its right-hand position in the groove.

Upon outward movement of the dog and the right-hand shoulder 54 into the groove 29, the abrupt shoulder 51 on the left side of the dog would be opposite the abrupt shoulder 29A on the left-hand groove 29, as shown in FIG. 8A. With pressure continuing to be held on the tool, the pipe string would then be raised to move the sleeve from its right-hand toward its left-hand position. As the sleeve is so moved, the packings straddle the port 21 and the left-hand shoulder 53 on the latch engages the shoulder on the left end of the recess in the housing so as to cause the beams to be forced inwardly, and thus force the dog and the right-hand shoulder inwardly with them and out of the groove 29, as shown in FIG. 9A. As this occurs, continued upward strain on the pipe string in a leftward direction would cause the freed tool to be moved abruptly upwardly, to indicate to the operator at the surface level that the sleeve had been fully shifted.

At this time, the operator could either continue to raise the pipe string preparatory to engaging in a groove of an upper sleeve to be shifted, or could lower the pipe string preparatory to engaging in a lower sleeve. Furthermore, with the latches engaged with the grooves thereof, the tool may be manipulated to either raise or lower the sleeve. Still further, in the event the operator desired to reopen port 21, the pipe string could be lowered and the latches engaged in the right-hand groove 30 for the purpose of shifting the sleeve back to its right-hand position. Obviously, this subsequent shifting could occur after a considerable time lapse, and, in fact, after shifting one or more of the other sleeves.

In any case, upon shifting of the sleeve to the left-hand position, the latches are unable to move outwardly into a gap or space between the left-hand end of the sleeve and the left end of the recess in the housing. Consequently, raising or lowering of the tool into a position within the sleeve will permit the latches to be moved outwardly only into the right-hand groove 30 in preparation for shifting the sleeve to its other position in the right-hand direction.

As in the case of the above described shifting of the sleeve to the left, the fluid pressure in the tool would be increased, as the tool was moved to a position in which the latches were opposite the right-hand groove 30, whereby the dogs 50 and both raised shoulders would be moved outwardly into the groove to dispose the right-hand abrupt shoulders 52 on the dogs in position to engage the oppositely facing shoulder 30A of the sleeve. Then, of course, as will be understood from FIGS. 10A and 10B and 11A and 11B, downward movement of the tool with the pipe string would shift the sleeve from its left-hand to its right-hand position. Again, as was true in the case of shifting of the sleeve to its left-hand position, this downward movement of the tool would cause the right-hand raised shoulder 54 to engage the shoulder on the right-hand end of the recess in the housing, thus retracting both the dogs and shoulders to force the bow springs inwardly, to the position shown in FIG. 11B, at which time the continued downward force on the tool body would cause the freed latches to move downwardly quickly with the body, thus indicating to the operator that the sleeve had been shifted.

Assuming that, for whatever reason, such as locking of the pistons, the inward urging of the bow springs was not effective to retract the latches despite the decrease in fluid pressure, a vertical strain on the pipe string would shear the threads 64 between one set of the tubular members 62 and 63, thus permitting the ends of the latch to move away from one another, despite their endwise confinement by the pistons 60 and 61. Thus, the latches may return to their retracted positions to permit retrieval of the shifting tool. As illustrated, this shearing has occurred between the right-hand tubular members 62 and 63, although it obviously could occur between the other set.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool for use in shifting a sleeve between upper and lower positions within a well conduit, wherein the sleeve has a groove about its inner surface having oppositely facing ends, said tool comprising:

a tubular body adapted for connection to a pipe string for lowering into the well conduit and having windows spaced about its circumference, a beam received in each window for guided radial movement with respect to the body and having inner and outer sides and opposite ends with a dog on its outer sides intermediate its ends, a sleeve extending longitudinally within the body to form annular spaces between them at the ends of the windows and in which the ends of the beams are received, each beam having an inner end facing the end of the other beam and an outer end, a piston longitudinally slidable within each annular space, means for admitting fluid within the body to the outer end of each piston, so that, when its pressure is raised to a predetermined level, the inner ends of the pistons are urged against the outer ends of the beams to force the beam to bend outwardly away from the sleeve to a position in which, upon movement of the body with the pipe string vertically within the well conduit, the dog will be forced into the groove in the sleeve when the dog is opposite the groove, said dog having a shoulder which faces one end of the groove, when disposed therein, to permit the sleeve to be shifted from one position to another upon vertical movement of the tool body with the pipe string, and a bow spring retained on the inner sides of the beams and arranged to retract the beams and thereby remove the dogs from the groove, following shifting of the sleeve and a predetermined reduction in such pressure, whereby the tool may be moved vertically within the well conduit.

2. A tool as in claim 1, including means responsive to a predetermined vertical force applied to the pipe string, when the dogs are in the groove, to release at least one end of the beam to move outwardly so that said beam may return to its retracted position.

3. A tool as in claim 1, wherein the body has reduced diameter sections sealably engaged with the sleeve of the outer ends of the pistons and having at least one orifice which passes through it.

4. A tool as in claim 3, wherein each piston also has an orifice which passes through it and a one-way check valve in the orifice which opens in a direction toward the adjacent piston.

5. A tool as in claim 3, wherein each piston also has an orifice which passes through it and a valve in the orifice arranged to permit fluid at a predetermined pressure to be relieved.

6. A tool as in claim 3, including another piston sealably slidable in the annular space on the side of each reduced diameter portion of the body opposite the first mentioned piston.

7. A well apparatus, comprising:

a housing connectible in a well conduit and having a bore therethrough, a sleeve vertically shiftable in the bore between upper and lower positions and having a groove about its inner surface, and a tool for shifting the sleeve between its upper and lower positions, comprising a tubular body connectible to a pipe string for lowering into the well conduit, latches carried by the body for radial movement between a retracted position in which the tool moves freely through the sleeve and an expanded position in which the latches will engage in the groove when opposite thereto, the groove and each latch having shoulders which, when the latches are engaged in the groove, to engage with one another to permit the sleeve to be shifted from a first to a second position upon vertical movement of the tool with the pipe string, means for moving the latches from their retracted to their expanded positions in response to a predetermined increase in the pressure of fluid within the tool body, and means yieldably urging the latches to their retracted positions so that, upon a predetermined reduction in such pressure, the latches may be retracted from the groove to permit the tool to move with the pipe string vertically out of the sleeve.

8. Well apparatus as in claim 7, wherein there is an annular recess about the bore of the housing which has a shoulder at one end, and each latch has a raised shoulder thereon in position to engage with the shoulder at one end of the recess, as the sleeve is shifted to its second position, so as to force the latches out of the groove and thus free the tool to move vertically with the pipe string.

9. Well apparatus as in claim 7, wherein the raised shoulders of the latches are of such size as to prevent their entry between the end of the sleeve and shoulder at one end of the recess if the sleeve is already shifted to such second position.

10. A well apparatus, comprising:

a housing connectible to a well conduit and having a bore therethrough, a sleeve vertically shiftable in the bore between upper and lower positions and having vertically spaced grooves about its inner surface, and a tool for shifting the sleeve between its upper and lower positions, comprising a tubular body connectible to a pipe string for lowering into the well conduit, latches carried by the body for radial movement between a retracted position in which the tool moves freely through the sleeve and an expanded position in which the latches will engage in a selected groove when opposite thereto, each groove having a shoulder at one end facing in an opposite direction to a shoulder at the end of the other groove, and each of the latches having shoulders facing in opposite directions one of which will, when the latches are expanded, engage with a shoulder of the selected groove to permit the sleeve to be shifted from first to second position upon movement of the tool with the well conduit in one vertical direction, means for moving the latches to their expanded positions in response to a predetermined increase in the pressure of fluid within the tool body, and means yieldably urging the latches to their retracted positions so that, upon a predetermined reduction in such pressure, the latches may be retracted from the groove to permit the tool to move with the pipe string vertically out of the sleeve.

11. A well apparatus as in claim 10, wherein the sleeve is received in a recess in the bore of the housing which has a shoulder at each end, and the latches have raised shoulders thereon in position to engage with a shoulder at one end of the recess, as the sleeve is shifted to one of its positions, so as to force the latches out of the groove and thus free the tool to move vertically with the pipe string.

12. A well apparatus as in claim 10, wherein the latches and raised shoulders of each latch are of such size as to prevent entry of the shoulders between the shoulders of the ends of the sleeve has and recess if the sleeve already shifted to such one position.

13. A well apparatus, comprising a plurality of housings connectible in vertically spaced-apart relation within a well conduit and each having a bore therethrough, a sleeve vertically shiftable in the bore of each housing between upper and lower positions and having a groove about its inner surface, and a tool for use in shifting each sleeve between its upper and lower positions, comprising a tubular body connectible to a pipe string for lowering into the well conduit, latches carried by the body for movement between a retracted position in which the tool moves freely through each sleeve and an expanded position in which the latches will engage in the groove of one sleeve when opposite thereto, the groove of each sleeve and each latch having opposed shoulders which, when the latches are expanded into the groove of that sleeve, are engageable with one another to permit the sleeve to be shifted between its upper and lower positions upon vertical movement of the tool with the pipe string, means for moving the latches to their expanded positions in response to a predetermined increase in the pressure of fluid within the tool body, and means yieldably urging the latches to their retracted positions so that, upon a predetermined reduction in such pressure, the latches may be retracted from the groove to permit the tool to move with the pipe string vertically out of the sleeve and into a position for shifting another sleeve.

14. A well apparatus as in claim 13, wherein each sleeve is received in a recess in the bore of the housing which has a shoulder at one end, and the latches have raised shoulders thereon on each side of the latches, in position to engage with a shoulder at one end of each groove, as the sleeve is shifted to one of its positions, so as to force the latches out of the groove and thus free the tool to move vertically with the pipe string.

15. A well apparatus as in claim 13, wherein the latches and raised shoulder of each latch are of such size as to prevent entry of the latches between the ends of the sleeve and each groove if the sleeve is already shifted to such one position.

* * * * *